US005452531A

United States Patent [19]

Graville et al.

[11] Patent Number: 5,452,531

[45] Date of Patent: Sep. 26, 1995

[54] CABINET AND LATCHLESS ADJUSTABLE IRONING BOARD

[76] Inventors: Donald E. Graville, 450 Lake Park Blvd., Fairmont, Minn. 56031; Mari G. Phelan, 2301 Blake Blvd. SE., Cedar Rapids, Iowa 52403

[21] Appl. No.: 350,644

[22] Filed: Dec. 7, 1994

[51] Int. Cl.[6] ..... D06F 81/06; A47B 46/00

[52] U.S. Cl. ..... 38/104; 108/39; 108/139; 312/30

[58] Field of Search ..... 38/103, 104, 106, 38/102, 137, 135; 108/42, 48, 50, 139; 312/21, 24, 26, 27, 30, 237, 230; 211/126; 248/121, 124, 125, 282, 283, 917–921

[56] References Cited

U.S. PATENT DOCUMENTS

| | | | |
|---|---|---|---|
| 1,096,327 | 5/1914 | Thorniley | 108/141 |
| 1,967,587 | 6/1934 | Long | 38/135 |
| 2,227,786 | 1/1941 | La Fee | 38/104 X |
| 2,287,646 | 6/1942 | Steele | 38/135 X |
| 2,605,155 | 7/1952 | Lewis | 108/139 |
| 2,612,422 | 9/1952 | Sarkus | 108/141 |
| 2,680,314 | 6/1954 | Snyder | 108/39 |
| 2,723,097 | 11/1955 | Tyler | 38/107 X |
| 3,157,379 | 11/1964 | Platakis | 248/278 |
| 3,455,256 | 7/1969 | Prager | 108/116 |
| 3,742,868 | 7/1973 | Garceau et al. | 108/39 |
| 3,965,588 | 6/1976 | Long | 38/103 |
| 4,085,961 | 4/1978 | Brown | 248/282 X |
| 4,480,556 | 11/1984 | Wilson et al. | 108/48 |
| 4,543,739 | 10/1985 | Zerhoch et al. | 38/103 X |
| 4,862,811 | 9/1989 | Davis | 108/48 X |
| 4,863,124 | 9/1989 | Ball et al. | 108/42 X |
| 4,961,388 | 10/1990 | Simpson | 108/42 |
| 4,995,681 | 2/1991 | Parnell | 38/103 X |
| 5,377,598 | 1/1995 | Kirchner et al. | 248/918 X |

FOREIGN PATENT DOCUMENTS

| | | | |
|---|---|---|---|
| 2124661 | 2/1984 | United Kingdom | 38/103 |

*Primary Examiner*—C. D. Crowder
*Assistant Examiner*—Ismael Izaguirre
*Attorney, Agent, or Firm*—Simmons, Perrine, Albright & Ellwood

[57] ABSTRACT

An ironing board apparatus includes a horizontally oriented ironing board mounted on an arm such that the ironing board continuously pivots about a first vertical axis spaced near a distal end of the arm, which, in turn, continuously pivots about a second vertical axis spaced near the other or proximal end of the arm such that the ironing board apparatus is angularly displaceable to and from a stored configuration and an operative configuration. The components interacting at the first and second axes are friction fit to resist forces and moments created during use of the ironing board apparatus. The ironing board apparatus includes a vertical supporting post with an encircling collar for adjusting the height of an ironing board thereof. The ironing board apparatus includes an accessory tray mounted on an underside of the ironing board. The invention also comprises a kit for using an existing base cabinet for the ironing board apparatus.

8 Claims, 2 Drawing Sheets

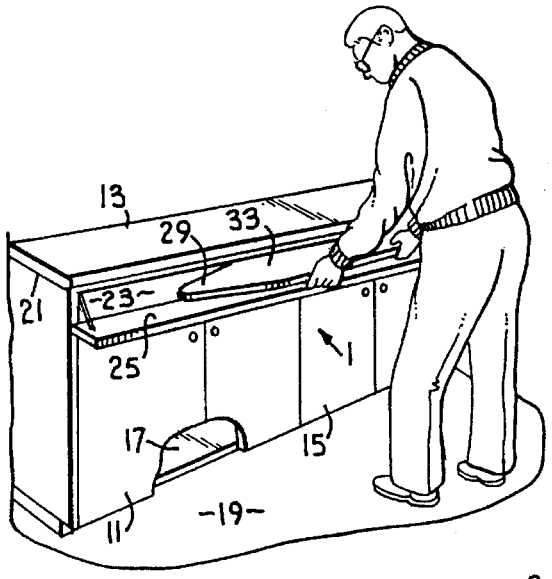
Fig.1.
Fig.2.
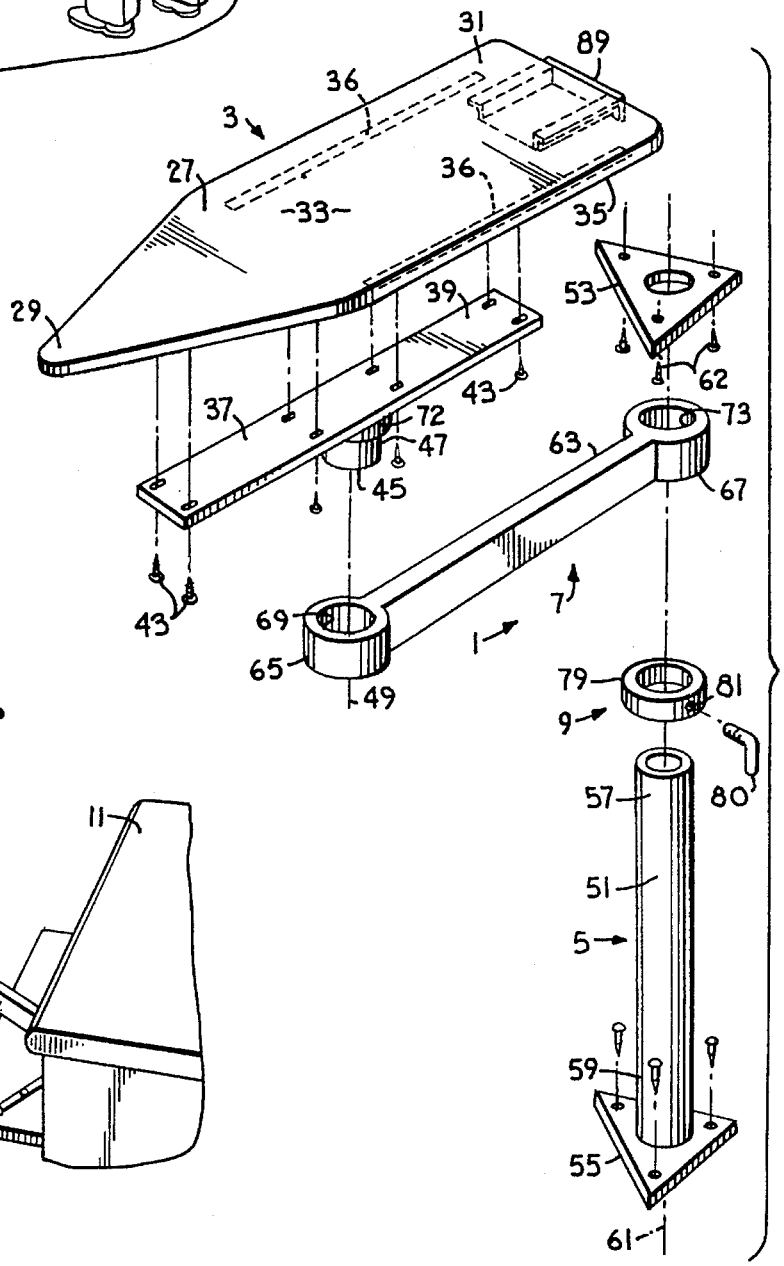
Fig.3.
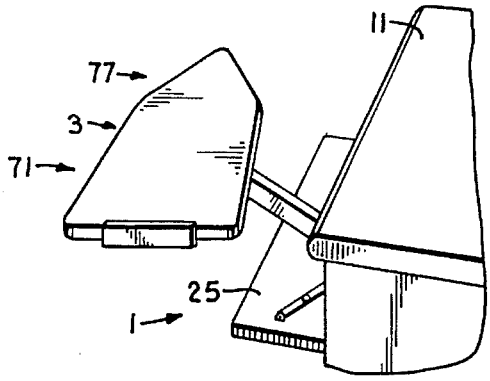

CABINET AND LATCHLESS ADJUSTABLE IRONING BOARD

BACKGROUND OF THE INVENTION

For some, ironing is one of those tasks which encourages procrastination. One of the primary reasons for such procrastination is the hassle involved with dragging a collapsible ironing board out of a closet or from behind a door. To say the least, un-collapsing the board and setting it up on its flimsy legs is an awkward and not overly enlightening experience. In use, the flimsy legs may provide some vertical stability to the ironing surface but leaves much to be desired in the way of providing horizontal stability for countering sidewise thrusts which are an inherent part of the ironing process.

After completion of the ironing duties, a user is usually presented with another challenge: collapsing the ironing board without pinching or scraping hands and fingers, and leaning the board somewhere without it falling and scraping paint and wallpaper on the walls and woodwork, or carefully folding the board into a wall cabinet at the risk of the board slipping and falling on the user. In order to avoid the unwelcome scrapes and pinches and avoid the un-collapsing and collapsing hassle, those who have extra floor space, and many who don't, may choose to leave the ironing board perpetually set up and tolerate the unsightly appearance of an erected ironing board.

Several attempts have been made to avoid some of the difficulties encountered with collapsible ironing boards. For example, U.S. Pat. No. 4,480,556, issued Nov. 6, 1984, to Kermit H. Wilson et al., discloses an "Adjustable Folding Ironing Board" wherein a first piece of a two-piece ironing board is pivoted about a horizontal axis of a wall cabinet, and the other piece is pivotable with respect to the first piece about a vertical axis of a turning portion. The ironing surface can be set at two different working heights. The Wilson et al. ironing board retains some of the undesirable features of the ordinary board in that each time the board is uncollapsed from, and re-collapsed into, the wall cabinet, the latches must be manipulated. Further, the Wilson et al. ironing board projects only at right angles from the wall cabinet and the ironing surface is confined to pivoting about the aforementioned vertical axis of the turning portion.

Similarly, U.S. Pat. No. 4,995,681, issued Feb. 6, 1991, to Clyde B. Parnell, discloses a "Built-In Ironing Center" wherein a first piece of a two-piece ironing board is pivoted about three horizontal axes of a wall cabinet, and the two-piece ironing board is further pivotable with respect to a plate about a vertical axis of a lazy-susan type support. The ironing surface can be set at three different elevations by use of two rods in cooperation with seven pairs of slots. Again, the Parnell ironing board retains some of the undesirable features of the ordinary board in that each time the board is uncollapsed from the wall cabinet, the rods must be latched in the appropriate slots, and each time the board is collapsed for storage in the wall cabinet, the rods must be unlatched from those slots. And, again, the support of the Parnell ironing board projects only at right angles from the wall cabinet and the ironing surface is confined to pivoting about the aforementioned vertical axis.

Another feature of most of the prior art ironing board devices is the angularly downwardly depending braces that are needed to provide acceptable stability to counter the thrusting moments created during the ironing process. Such braces are an invitation to danger for the fingers of toddlers who want to be near, but who may be beneath an ironing board out of sight of, an ironing parent.

Another feature of some of the prior art ironing board devices involves closing a doorway or blocking a passageway to use the devices.

What is needed is an ironing board that is latchless, both during preparation for use and during preparation for storage, that is not confined to pivoting about a single vertical axis, that does not have angularly downwardly depending supporting braces, that does not block a doorway or other passageway, and which is available in kit form for installation in an existing base cabinet.

SUMMARY OF THE INVENTION

An improved ironing board apparatus is provided for a latchless ironing board apparatus having a base cabinet; an ironing board; a bracket, attached to the ironing board, having a downwardly depending connector; a post with an upper end and a lower end; an upper adapter connecting the post upper end to the base cabinet, and a lower adapter connecting the post lower end to the base cabinet such that the post is generally vertically oriented; a pivot with a distal end connected to the connector such that the ironing board is continuously pivotable relative to the pivot arm 360° about a generally vertically oriented first axis such that the ironing board is angularly displaceable relative to the pivot arm, and a proximal end connected to the post such that the pivot arm is continuously pivotable relative to the post about a generally vertically oriented second axis such that the ironing board is angularly displaceable to and from a stored configuration and an operative configuration, and wherein the distal end is connected to the connector and the proximal end is connected to the post such that each connection operably, frictionally and cooperatively resists rotations about respective axes thereof as the ironing board apparatus is used for ironing purposes. The distal end is connected to the connector such that the connector is upwardly releasable from the distal end such that the ironing board can be lifted upwardly, clear of the distal end, and switched end-to-end to convert the ironing board apparatus to and from a generally lefthanded configuration and a righthanded configuration. The ironing board apparatus also includes a collar that is releasably connected to the post such that the pivot arm is continuously vertically adjustable relative to the post and such that the ironing board is spaceable in close proximity to an underside of the top of the base cabinet; and a tray slidably attached to an underside of the ironing board.

The present invention also includes an improved ironing board apparatus as a kit for installation in an existing base cabinet.

OBJECTS AND ADVANTAGES OF THE INVENTION

Therefore, the principal objects and advantages of the present invention are: to provide an ironing board apparatus that requires no latching or unlatching as the ironing board apparatus is prepared for use; to provide such an ironing board apparatus that requires no latching or unlatching as the ironing board apparatus is prepared for storage; to provide such an ironing board apparatus that is continuously angularly displaceable about a pair of vertical axes and requires no angular displacement about a horizontal axis for preparing for use or for storing; to provide such an ironing board apparatus that includes a base cabinet or is installable as a kit in an existing base cabinet; to provide such an ironing board apparatus that frictionally resists sidewise thrusting moments that are inherent in an ironing process; to provide such an ironing board apparatus that has a tray for containing accessories and/or supporting an iron during the ironing process; to provide such an ironing board apparatus that eliminates the pinches and scrapes encountered with other ironing board apparatus; to provide such an ironing board apparatus that eliminates angularly downwardly depending support braces; and to generally provide such an ironing board apparatus that is simple and easy to use and maintain, easy to operate efficiently and reliably, and which generally performs the requirements of its intended purposes.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a latchless ironing board apparatus showing a portion cut away to reveal details thereof, according to the present invention.

FIG. 2 is an enlarged, exploded view of portions of the latchless ironing board apparatus that fit within a base cabinet and which comprise the components of a kit, according to the present invention.

FIG. 3 is an enlarged and fragmentary, perspective view of the latchless ironing board apparatus, showing the apparatus in an operative configuration.

DETAILED DESCRIPTION OF THE INVENTION

Figure 4:
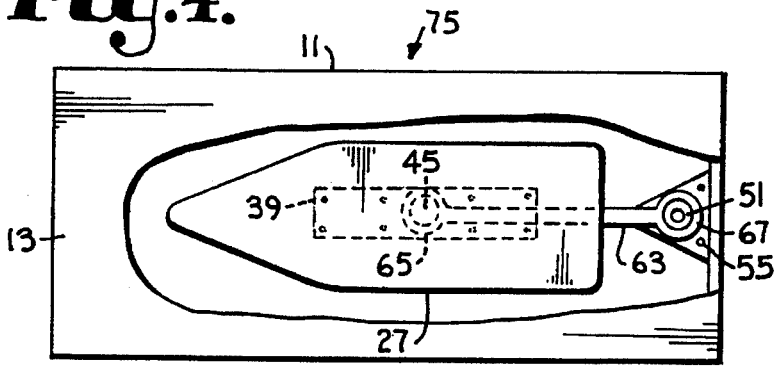
FIG. 4 is a plan view of the latchless ironing board apparatus showing a portion cut away to reveal details thereof.
Figure 5:
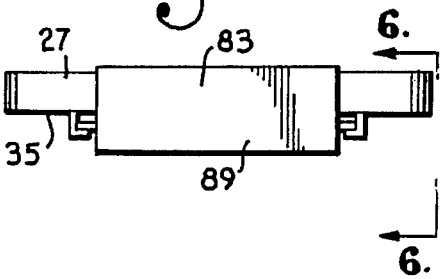
FIG. 5 is a fragmentary end elevation view of the latchless ironing board apparatus showing an accessory tray thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

A latchless ironing board apparatus 1, as shown in FIGS. 1 through 7, generally comprises platform means 3, support means 5, pivot means 7 and adjustment means 9. A preferred embodiment of the apparatus 1 includes a base cabinet 11, with a generally horizontally oriented top 13 and a bottom 15. For some applications of the present invention, the base cabinet 11 may have a cabinet floor 17; in other applications, the base cabinet 11 may be floorless but resting upon an underlying floor 19. The cabinet top 13 has an underside 21. The base cabinet 11 generally has a opening 23 located approximately where drawers are normally found in other base cabinets. If desired, a door 25 may be hingedly connected to the base cabinet 11 to provide closure for the opening 23 when the apparatus 1 is not in use.

The platform means 3 generally includes an ironing board 27 having a tapered end 29 and a base end 31. As an example, the ironing board 27 may have a width of approximately fifteen inches (approximately 38 cm.) and a length of approximately fifty-four inches (approximately 137 cm.). It is to be understood, however, that the ironing board 27 may have any width and any length as desired for a particular application. The ironing board 27 has an upper surface 33, which is generally planar and horizontally oriented. Preferably, the ironing board 27 also has a lower surface 35, which is also generally planar and horizontally oriented. If desired, finger grooves 36 may be formed in the lower surface 35 to assist with extension of the ironing board apparatus 1 as herein described. For some applications, the lower surface 35 may not be planar; in that event, the lower surface 35 is configured to attach to other components of the apparatus 1 as hereinafter described. The ironing board 27 may be constructed of rigid material, such as wood or metal, such that a sturdy supporting foundation is provided to reliably withstand the rigors of the ironing process. For example, the ironing board 27 may be constructed of wood having a thickness of ¾ inch (approximately 19 mm.).

A bracket 37, having a stabilizer plate 39, is fixedly secured to the lower surface 35 of the ironing board 27, such as by screws 43 or other suitable fasteners or equivalents thereof. As an example, the stabilizer plate 39 may be constructed of one-eighth inch (approximately 3.2 mm.) steel plate and have a length of approximately twenty-four inches (approximately 61 cm.). The bracket 37 also has a connector 45, which is approximately centrally located to, and depends generally downwardly from, the plate 39. The connector 45 has a peripheral outer surface 47, which is generally cylindrically shaped about a generally vertically oriented axis 49.

The support means 5 generally includes a post 51, an upper adapter 53, and a lower adapter 55. The post 51 is generally cylindrically shaped, with an upper end 57 and a lower end 59. As an example, the post 51 may have a diameter of approximately one and three-fourths inches (approximately 4.4 cm.) and a height or length of approximately thirty three inches (approximately 84 cm.). The upper adapter 53 and lower adapter 55 are adapted to cooperatively align a longitudinal axis 61 of the post 51 in a generally upright orientation by connecting the upper end 57 near the top of the base cabinet 11, such as by attaching the upper adapter 53 to the underside 21 of the top 13 with screws or other suitable means, and by connecting the lower end 59 near the bottom 15 of the base cabinet 11. Preferably, one or both of the upper adapter 53 and the lower adapter 55 are fixedly secured to the post 51. For example, the upper adapter 53 may be constructed of wood, and the lower adapter 55 may be constructed of ¼-inch (approximately 6.3 mm.) steel plate and welded to the post 51, as shown in FIG. 2. It is to be understood that the upper adapter 53 and the lower adapter 55 may have a triangular configuration, as shown in FIG. 2, or any other suitable configuration as desired.

The pivot means 7 generally includes a pivot arm 63 having a distal end 65 and a proximal end 67. The pivot arm 63 is constructed of rigid material, such as stainless steel or other suitable material. As an example, the pivot arm 63 may have a length of approximately thirty-four inches (approximately 86 cm.) and a height at the distal end 65 and at the proximal end 67 of approximately two inches (approximately 5 cm.). The distal end 65 is connected to the connector 45, such as by a throughbore 69 in the distal end 65 encircling the connector 45, such that the ironing board 27 is continuously pivotable relative to the pivot arm 63 about the axis 49 such that the ironing board 27 is continuously angularly displaceable relative to the pivot arm 63.

Preferably, the distal end 65 is connected to the connector 45 such that the ironing board 27, the stabilizer plate 39, and the connector 45 are releasably removable from the distal end 65—such as by manually lifting the ironing board 27 and the stabilizer plate 39 upwardly, clear of the distal end 65—such that the ironing board 27 in readily convertible to and from a generally lefthanded configuration to a generally righthanded configuration, one of which orientations is indicated by the numeral 71 in FIG. 3. If desired, the connector 45 may include a hub 72 which bears against the distal end 65 to provide additional clearance between the ironing board 27 and the pivot arm 63. Preferably, the combined height of the ironing board 27, the bracket 37, the connector 45 including the hub 72, and the pivot arm 63 is less than five inches (approximately 12.7 cm.).

The proximal end 67 is connected to the post 51, such as by a throughbore 73 in the proximal end 67 encircling the post 51, such that the pivot arm 63 is continuously pivotable relative to the post 51 about the axis 61 such that the ironing board 27 is continuously angularly displaceable to and from a stored configuration, as indicated by the numeral 75 in FIG. 4, and an operative configuration, as indicated by the numeral 77 in FIG. 3. It is to be understood that the post 51 may be installed near the right-hand side of the base cabinet 11, as shown in FIG. 4, or near the left-hand side, as desired. Preferably, the dimensions of the distal end 65 and the proximal end 67 are substantially similar such that the ends 65 and 67 are interchangeable.

The distal end 65 is connected to the connector 45 and the proximal end 67 is connected to the post 51 such that each of those connections operably and frictionally resists rotations about their respective axes 49 and 61 as said ironing board 27 is subjected to moments about the axes 49 and 61 created during the ironing process. Such frictional resistance may be provided by close tolerance machining of the dimensions of the abutting faces of the interacting components, namely, between the outer peripheral surface 47 of the connector 45 and the throughbore 69, and between the throughbore 73 and an outer peripheral surface 79 of the post 51, or by any other suitable frictional enhancing means. For example, a very slight taper may be machined into each of the connector 45 and the throughbore 69 such that a small gravitational force component is entered into the frictional relationship between the connector 45 and the throughbore 69.

The pivot arm 63 is adapted to provide the necessary structural strength to support and resist the downward and twisting forces and moments exerted on the ironing board 27 during the ironing process. Thus, the pivot arm 63 eliminates the need for downwardly depending braces normally utilized to counter such moments and forces. As a result, the pivot arm 63 provides the added benefit of improved safety for the exploring fingers of a toddler playing on the floor near an ironing parent.

The adjustment means 9 generally includes a collar 79 encircling the post 51, or other suitable means, for selecting and maintaining a selected elevation of the pivot arm 63 relative to the post 51. The collar 79 is releasably secured to the post 51 by a threaded thumb lever 80 in conjunction with a tapped bore 81, or other suitable arrangement, such that the pivot arm 63 is continuously and vertically adjustable along the post 51 and such that the ironing board 27 is spaceable in close proximity to the underside 21 of the top 13 of the base cabinet 11.

Figure 6:
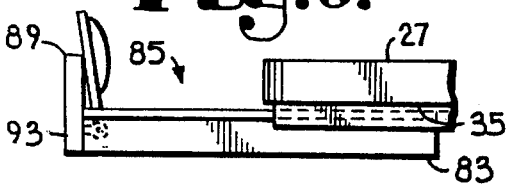
FIG. 6 is an enlarged and fragmentary, side elevation view of the latchless ironing board apparatus, taken along line 6—6 of FIG. 5, showing the accessory tray in an extended configuration.

If desired, an accessory tray 83 may be provided for holding pins, a bottle of spray starch, and the like, for ready accessibility thereof to a user during the ironing process. Preferably, the tray 83 is slidably attached to the lower surface 35 of the ironing board 27 such that the tray 83 may be extended outwardly from the ironing board 27, as indicated by the numeral 85 in FIG. 6, as the ironing board 27 is positioned in the operative configuration 77, and may be retracted substantially beneath the lower surface 35 of the ironing board 27, as indicated by the numeral 87 in FIG. 7. A tray end 89 extends upwardly to serve a dual purpose as a stop 91, as shown in FIG. 7, to prevent the tray 83 from being pushed completely beneath the ironing board 27, which would otherwise cause extension of the tray 83 to be more difficult, and as a pull 93, as shown in FIG. 6, to simplify extension of the tray 83 to the extended configuration 85.

Figure 7:
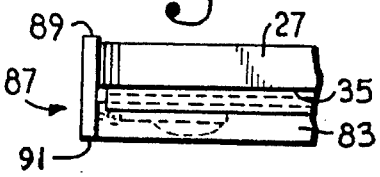
FIG. 7 is an enlarged and fragmentary, side elevation view of the latchless ironing board apparatus similar to FIG. 6, but showing the accessory tray in a retracted configuration, according to the present invention.

The tray 83 may include a hinged mechanism 95 having a pin cushion 97 such that the latter can be extended upwardly during the ironing process, as shown in FIG. 7, and folded into the tray 83 when not in use, as shown in FIG. 7.

An application of the present invention by a user involves extending the ironing board 27 from the stored configuration 75 to the operative configuration 77 by pivoting the door 25 (if present) out of the way, reaching through the opening 23, and grasping the ironing board 27. As the apparatus 1 is latchless in order to avoid the pinches and scrapes normally experienced with latch-type ironing boards, the user simply pulls the ironing board 27 outwardly, as indicated in FIG. 1. As a result, the proximal end 67 of the pivot arm 63 pivots about the longitudinal axis 61 relative to the post 61 such that the distal end 65 of the pivot arm 63, with the ironing board 27 attached thereto, is angularly displaced through the opening 23, spacing the ironing board 27 generally alongside but apart from the base cabinet 11. The user will encounter some resistance to extension of the ironing board 27 due to the "tight" frictional fit between the throughbore 73 and the post 51 to assure that the pivot arm 63 will tend to remain as positioned by the user and to resist moments created during the ironing process as hereinbefore described.

Also, as the user angularly displaces the ironing board 27 as desired relative to the base cabinet 11, the distal end 65 of the pivot arm 63 may be pivoted about the axis 49 relative to the connector 45. Again, the user will encounter some resistance to such angular displacement of the ironing board 27 due to the "tight" frictional fit between the throughbore 69 and the connector 45 to assure that the ironing board 27 will tend to remain where positioned by the user and to resist moments created during the ironing process as hereinbefore described.

If the user desires to reverse the handedness of the tapered end 29 relative to the base end 31, the user can vertically lift the connector 45 clear of the throughbore 69, reverse the tapered end 29 and the base end 31 of the ironing board 27, and reinsert the connector 45 into the throughbore 69.

The user may then pull the tray end 89 outwardly, away from the ironing board 27 to provide access to pins, scissors, etc., stored therein and to provide a platform for supporting a bottle of spray starch, or the like.

To the extent permissible by the height of the opening 23 in relation to the combined height of the pivot arm 63 and the other components mounted thereon (including, perhaps, an ironing board cover and pad), which must navigate the opening 23 as anticipated by the invention, the elevation of the ironing board 27 may be changed to adapt to users of different heights by adjusting the collar 79 vertically relative to the post 51.

The entire process of extending the ironing board apparatus 1 from the stored configuration 75 to the operative configuration 77 is a latch-free or latchless operation. Similarly, returning the ironing board apparatus 1 from the operative configuration 77 to the stored configuration 75 is a latchless operation. Simply slide the tray 83 (if used) to the retracted configuration 87, and press the ironing board 27 through the opening 23—no latching, no latch releasing, no folding, no lifting, no pinching, etc.; basically only simple pivoting about the two vertical axes 49 and 61.

The present invention also comprises a kit for converting an existing base cabinet (not shown but similar to the base cabinet 11) for use with the remaining components of the apparatus 1. In that event, drawers of the existing base cabinet and spacers therebetween are removed from the existing base cabinet by methods commonly known in the carpentry art. The post 51 is installed internally to the existing base cabinet along one side, similar to that shown in FIG. 4, by connecting the upper end 57 of the post 51 to the underside 21 of the top 13 of the existing base cabinet with the upper adapter 53, and by connecting the lower end 59 of the post 51 to the cabinet floor 17 or the room floor 19 beneath the existing base cabinet, as appropriate, with the lower adapter 55. The remaining components of the apparatus 1 are connected to the post 51 as hereinbefore described.

It is to be understood that the above invention is not limited to ironing board applications but is also applicable to sewing, hobbies and crafts, and many other applications.

It is to be understood that while certain forms of the present invention have been illustrated and described herein, it is not to be limited to the specific forms or arrangement of parts described and shown.

What is claimed and desired to be secured by Letters Patent is as follows:

1. An apparatus, comprising:

(a) a base cabinet having a top;

(b) platform means having an ironing board with a generally horizontally oriented upper surface;

(c) support means having an upper end, attached to an underside of said top of said base cabinet, and a lower end;

(d) pivot means for interconnecting said platform means to said support means; said pivot means adapted to pivot about a first upright axis such that said platform means is continuously and angularly displaceable to and from a stored configuration and an operative configuration, and about a second upright axis such that said platform means is continuously and angularly displaceable relative to said base cabinet;

(e) adjustment means for vertically adjusting the elevation of said platform means; and (f) tray means connected to said platform means for holding accessories.

2. An apparatus, comprising:

(a) a base cabinet having a top;

(b) platform means having an ironing board with a generally horizontally oriented upper surface;

(c) support means including a cylindrical, upright standard having an upper end and a lower end; said support means including a first plate adapted to secure said upper end to an underside of said top of said base cabinet;

(d) pivot means for interconnecting said platform means to said support means; said pivot means adapted to pivot about a first upright axis such that said platform means is continuously and angularly displaceable to and from a stored configuration and an operative configuration, and about a second upright axis such that said platform means is continuously and angularly displaceable relative to said base cabinet;

(e) adjustment means for vertically adjusting the elevation of said platform means; and (f) tray means connected to said platform means for holding accessories.

3. The apparatus according to claim 2, wherein said support means includes a second plate which is adapted to secure said lower end to a lower part of said base cabinet.

4. The apparatus according to claim 2, wherein said support means includes a second plate which is adapted to secure said lower end to the floor beneath the base cabinet.

5. An apparatus, comprising:

(a) a base cabinet having a top;

(b) platform means having an ironing board with a generally horizontally oriented upper surface; said platform means spaced in close proximity to an underside of said top of said base cabinet;

(c) support means having an upper end and a lower end, at least one end of which is attached to said base cabinet;

(d) pivot means for interconnecting said platform means to said support means; said pivot means adapted to pivot about a first upright axis such that said platform means is continuously and angularly displaceable to and from a stored configuration and an operative configuration, and about a second upright axis such that said platform means is continuously and angularly displaceable relative to said base cabinet;

(e) adjustment means for vertically and continuously adjusting the elevation of said platform means relative to said support means; and (f) tray means connected to said platform means for holding accessories.

6. A kit for installing a latchless ironing board in a base cabinet having a top, said kit comprising:

(a) a support standard having an upper end and a lower end;

(b) a pair of plates wherein a first one of said pair of plates is adapted to secure said upper end of said support standard to an underside of said top and the other one of said pair of plates is adapted to secure said lower end of said support standard to the floor beneath the base cabinet;

(c) an ironing board mechanism;

(d) a pivot arm having a first end and a second end, wherein;

(1) said first end is adapted to be connectable to said ironing board mechanism such that said ironing board mechanism is operably and continuously pivotable about a first upright axis relative to said pivot arm, and (2) said second end is adapted to be connectable to said upper end of said support standard such that said pivot arm is pivotable about a second upright axis relative to said support standard and, further, such that said ironing board mechanism is angularly displaceable to and from a stored configuration and an operable configuration;

(e) a stop connectable to said support standard such that elevation of said pivot arm is continuously adjustable relative to said support standard; said stop adapted to adjust said pivot arm such that said ironing board mechanism is spaced in close proximity to said top of the base cabinet as said ironing board mechanism assumes said stored configuration; and (f) a tray slidably attached to an underside of said ironing board mechanism.

7. A latchless ironing board apparatus, comprising:

(a) a base cabinet having a top and a bottom;

(b) an ironing board having generally planar, horizontally oriented upper and lower surfaces; said ironing board having a tapered end and a base end;

(c) a bracket with a cylindrically shaped connector; said bracket fixedly secured to said lower surface of said ironing board such that said connector depends generally downwardly therefrom;

(d) a support standard having a cylindrically shaped post with an upper end and a lower end, an upper adapter connected to said upper end, and a lower adapter connected to said lower end; said upper adapter attached near said top of said base cabinet and said lower adapter attached near said bottom of said base cabinet such that said post is generally vertically oriented;

(e) a pivot arm having a first end and a second end; said first end connected to said connector such that said ironing board is continuously pivotable relative to said pivot arm about a first substantially vertically oriented axis such that said ironing board is angularly spaceable relative to said pivot arm; said first end connected to said connector such that said connector is upwardly releasable from said first end such that said ironing board is convertible to and from said tapered end being oriented generally toward the left of a user and said tapered end being oriented generally toward the right of a user; said second end connected to said post such that said pivot arm is continuously pivotable relative to said post about a second substantially vertically oriented axis such that said ironing board is angularly translatable to and from a stored configuration and an operative configuration; said first end connected to said connector and said second end connected to said post such that each operably and frictionally resists rotations about respective axes thereof;

(f) a collar releasably connected to said post such that said pivot arm is continuously vertically adjustable relative to said post and such that said ironing board is spaceable in close proximity to an underside of said top of said base cabinet; and (g) a tray slidably attached to an underside of said ironing board.

8. A kit for installing a latchless ironing board in a base cabinet having a top, said kit comprising:

(a) a support standard having an upper end and a lower end;

(b) a pair of plates wherein a first one of said pair of plates is adapted to secure said upper end of said support standard to an underside of said top and the other one of said pair of plates is adapted to secure said lower end of said support standard to a bottom portion of the base cabinet;

(c) an ironing board mechanism;

(d) a pivot arm having a first end and a second end, wherein, (1) said first end is adapted to be connectable to said ironing board mechanism such that said ironing board mechanism is operably and continuously pivotable about a first upright axis relative to said pivot arm, and (2) said second end is adapted to be connectable to said upper end of said support standard such that said pivot arm is pivotable about a second upright axis relative to said support standard and, further, such that said ironing board mechanism is angularly displaceable to and from a stored configuration and an operable configuration;

(e) a stop connectable to said support standard such that elevation of said pivot arm is continuously adjustable relative to said support standard; said stop adapted to adjust said pivot arm such that said ironing board mechanism is spaced in close proximity to said top of the base cabinet as said ironing board mechanism assumes said stored configuration; and (f) a tray slidably attached to an underside of said ironing board mechanism.

* * * * *

UNITED STATES PATENT AND TRADEMARK OFFICE

CERTIFICATE OF CORRECTION

PATENT NO. : 5,452,531

DATED : September 26, 1995

INVENTOR(S) : Donald E. Graville, et al

It is certified that error appears in the above-indentified patent and that said Letters Patent is hereby corrected as shown below:

On the title page:

In the "References Cited" area: delete "1,967,587" and substitute therefor --1,964,587--.

Signed and Sealed this

Sixteenth Day of January, 1996

Bruce Lehman

*Attest:*

BRUCE LEHMAN

*Attesting Officer*

*Commissioner of Patents and Trademarks*